US005708982A

United States Patent [19]

Armani

[11] Patent Number: 5,708,982

[45] Date of Patent: Jan. 20, 1998

[54] HAIR TOWEL

[76] Inventor: Aida M. Armani, 308 Everest Cir., West Chester, Pa. 19382

[21] Appl. No.: 684,604

[22] Filed: Jul. 19, 1996

Related U.S. Application Data

[60] Provisional application No. 60/001,411, Jul. 25, 1995.

[51] Int. Cl. [6] ..... A41D 1/00; A41D 23/00

[52] U.S. Cl. ..... 2/171; 2/174; 2/204

[58] Field of Search ..... 2/171, 174, 202, 2/203, 204, 195.2, 60, 171.3, 183, 182.7, 206, 207, 195.8, 181.2, 88, 89, 69, 69.5

[56] References Cited

U.S. PATENT DOCUMENTS

| | | | |
|---|---|---|---|
| D. 119,464 | 3/1940 | Small . | |
| D. 275,827 | 10/1984 | Henry | D6/608 |
| D. 340,795 | 11/1993 | Matthews | D2/861 |
| 958,329 | 5/1910 | Siegel | 2/207 |
| 1,020,912 | 3/1912 | Kerr | 2/207 |
| 1,305,712 | 8/1919 | Dupont | 2/207 |
| 1,386,692 | 8/1921 | Dupont | 2/204 |
| 1,722,067 | 7/1929 | Vaxes . | |
| 1,782,925 | 11/1930 | Junas, Jr. . | |
| 2,056,998 | 10/1936 | Beiter | 2/50 |
| 2,093,483 | 9/1937 | Sackett | 2/50 |
| 2,222,896 | 11/1940 | Cogburn | 2/19 |
| 2,246,035 | 6/1941 | Elliot | 2/50 |
| 2,364,568 | 12/1944 | Tiscornia | 2/50 |
| 2,439,382 | 4/1948 | De Grazia | 2/203 |
| 2,654,092 | 10/1953 | Brennish | 2/50 |
| 2,708,273 | 5/1955 | Bonaventura | 2/196 |
| 2,744,252 | 5/1956 | Cansler | 2/50 |
| 2,794,985 | 6/1957 | Brennish | 2/49 |
| 2,857,599 | 10/1958 | Wallace | 2/49 |
| 5,249,308 | 10/1993 | Blume | 2/174 |

FOREIGN PATENT DOCUMENTS

| | | | |
|---|---|---|---|
| 571 | 5/1911 | United Kingdom | 2/204 |

*Primary Examiner*—Jeanette E. Chapman
*Attorney, Agent, or Firm*—Eugene Chovanes

[57] ABSTRACT

A hair towel that can be first used as a cape during hair washing and treatment, and then fashioned into a bag about the head by pulling a drawstring. The towel can then be secured to the head by tying the drawstring.

1 Claim, 12 Drawing Sheets

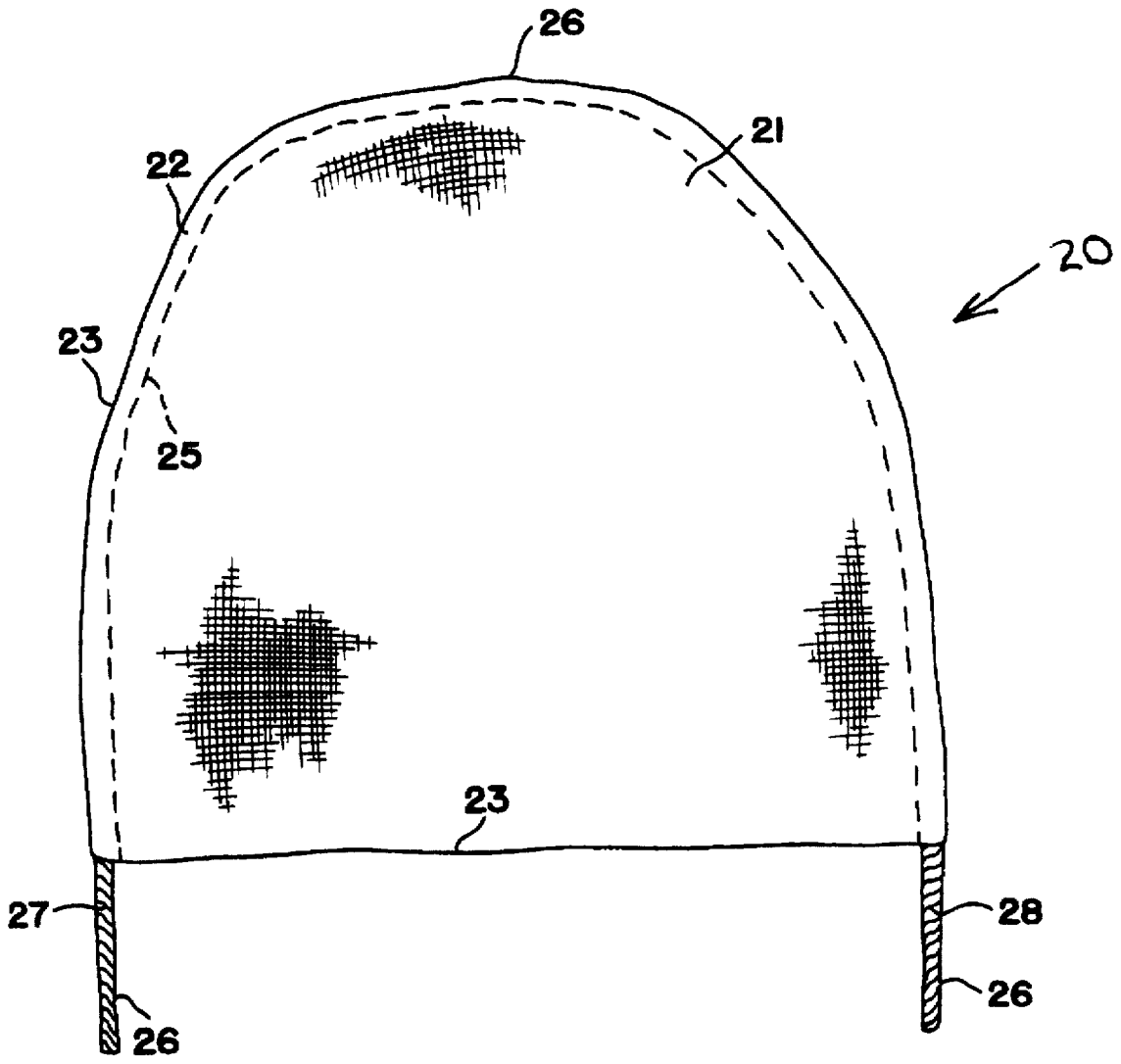
FIG. A

HAIR TOWEL

This application is a continuation of provisional application Ser. No. 60/001,411, filed Jul. 25, 1995, now abandoned.

BACKGROUND OF THE INVENTION

The care of human hair involves washing, drying and often the application of various liquids in an effort to restore and maintain optimum hair quality and hygiene.

In many instances, particularly with the hair of females, hair is relatively long and abundant.

Particularly in commercial establishments, towels and the like are used to protect the person during the hair treatment by draping the towel over the shoulders. Additionally, towels are used to dry the hair and in some instances wrap the hair for a time subsequent to the liquid treatment or washing. The towels envelop the hair in generally a haphazard fashion and are tucked in the manner of a turban.

SUMMARY OF THE PRESENT INVENTION

A towel is provided having a drawstring threaded through the curved perimeter of a generally semicircular shaped towel. The towel is used first as a cape during the washing or liquid treatment, and is then drawn around the hair to provide a bagging or snood effect wherein the drawstring acts to form the bag and to capture the hair within the bag.

BRIEF DESCRIPTION OF DRAWINGS

FIG. A is a plan view of a hair towel of the invention spread out without the drawstring being drawn, so that the towel is in a fully opened position.

FIG. 1 shows the towel draped over the shoulders of an individual whose hair has been washed or otherwise treated with a liquid, wherein the hair is in a relatively moist condition.

FIG. 2 is a side view, 2—2 of FIG. 1.

FIG. 3 is a back view of FIG. 1.

FIG. 4 shows the drawstring being pulled up.

FIG. 5 is a side view, 5—5, of FIG. 4.

FIG. 6 is a back view of FIG. 4.

FIG. 7 is a back oblique of FIG. 4.

FIG. 8 shows the drawstring being pulled further.

FIG. 9 is a view similar to FIG. 8 showing the drawstring being pulled.

FIG. 10 shows a "loop" of drawstring being formed about the hair. The lower part of the towel is being pulled up over the hair.

FIG. 11 is a side view of FIG. 10.

FIG. 12 is a back view of FIG. 10.

FIG. 13 is an oblique back view of FIG. 10.

FIG. 14 shows the drawstring being pulled closed.

FIG. 15 is a side view of FIG. 14.

FIG. 16 is a back view showing the drawstring being tied in the neck area.

FIG. 17 shows the hair towel in place.

FIG. 18 shows a "looping" of the drawstring.

FIG. 19 shows a further tying of the drawstring.

FIG. 20 shows the drawstring in place.

DESCRIPTION OF THE PREFERRED EMBODIMENT

Figure 1:
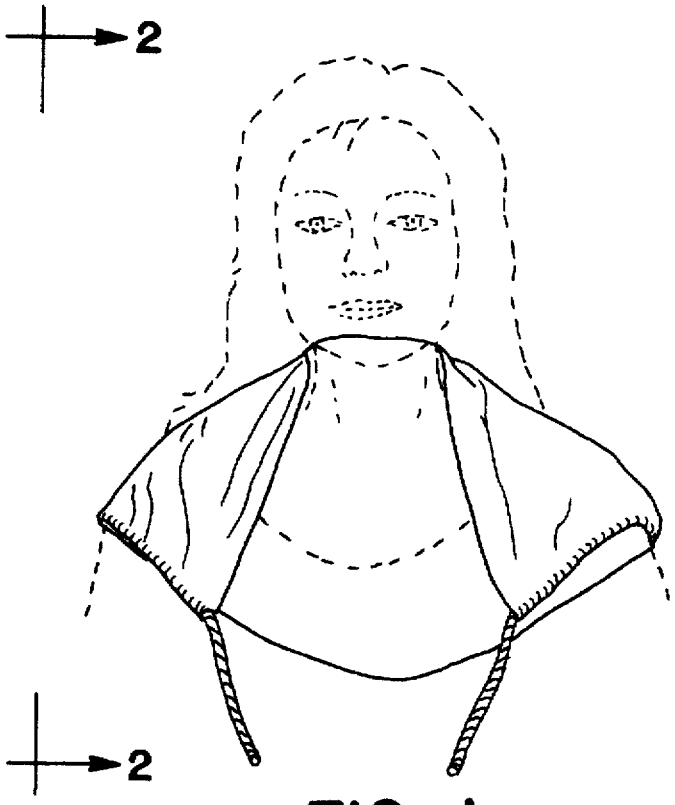
FIGS. 1 through 20 inclusive are drawings of the hair towel as it is used in the intended procedure.
Figure 2:
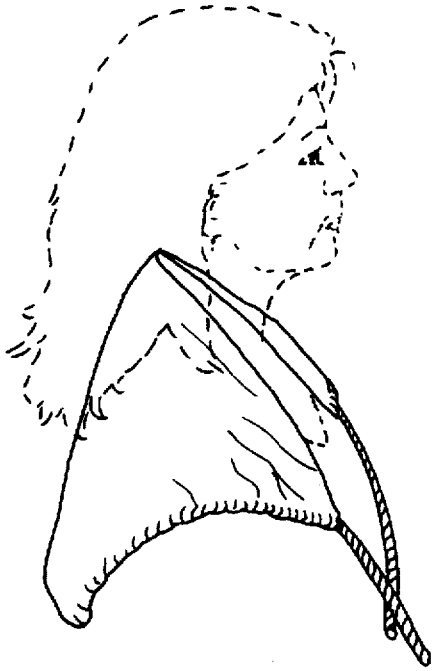
Figure 3:
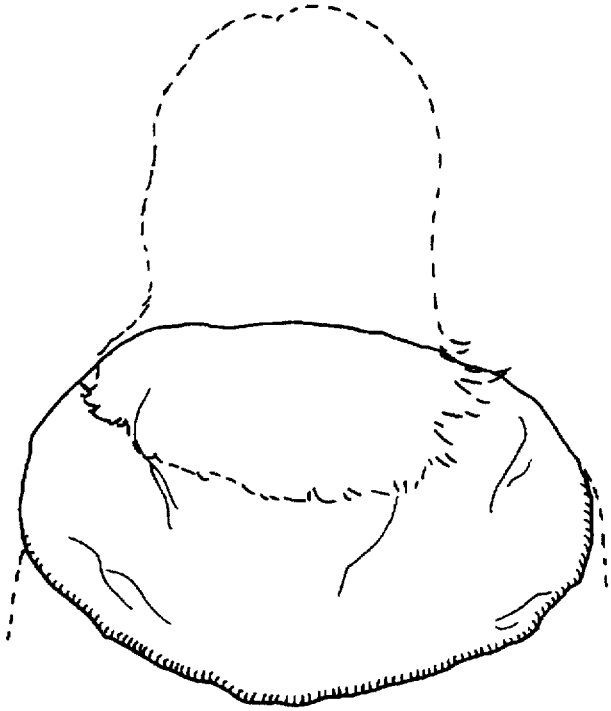
Figure 4:
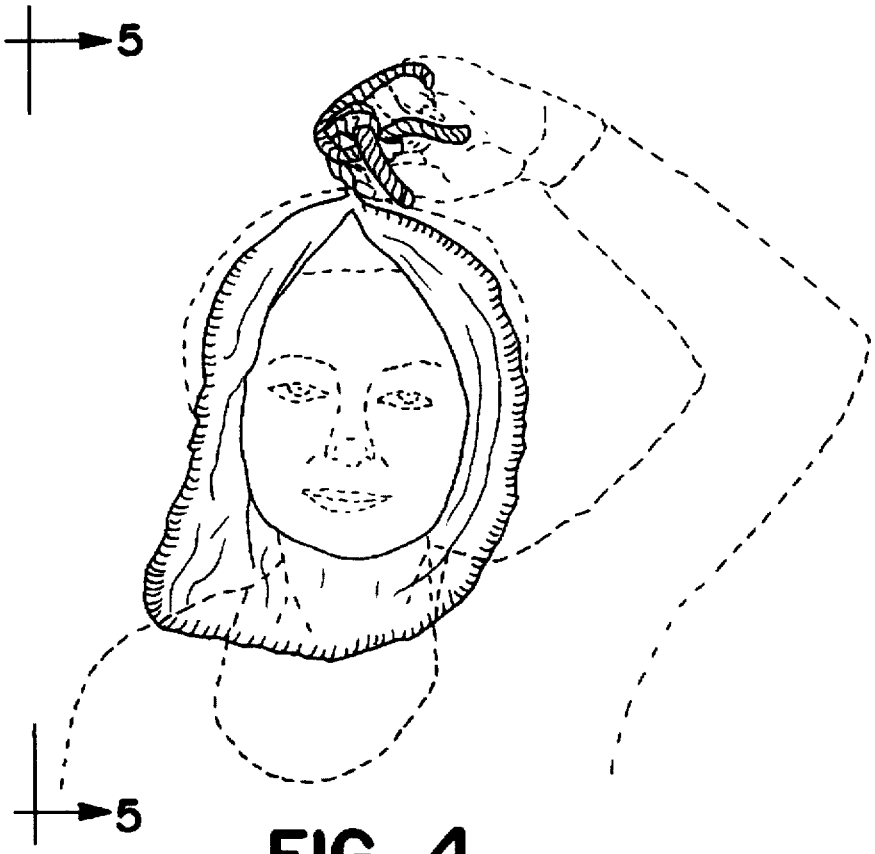
Figure 5:
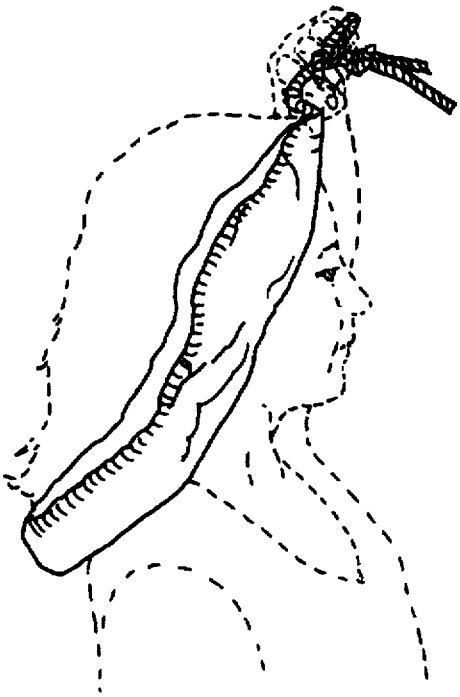
Figure 6:
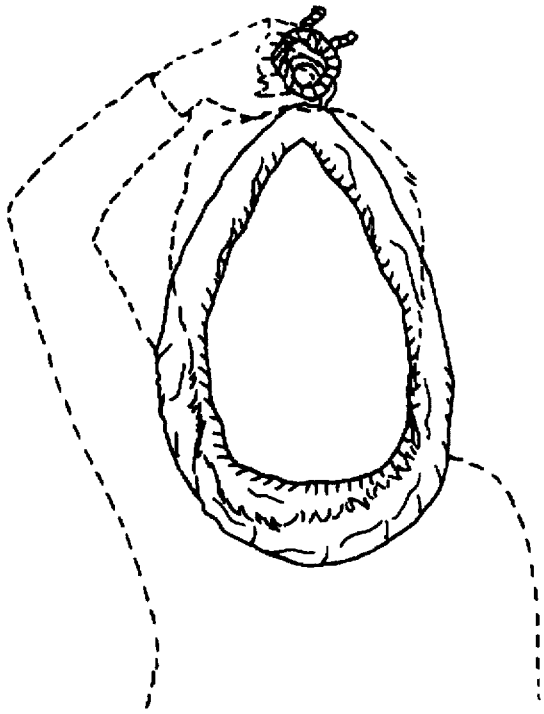
Figure 7:
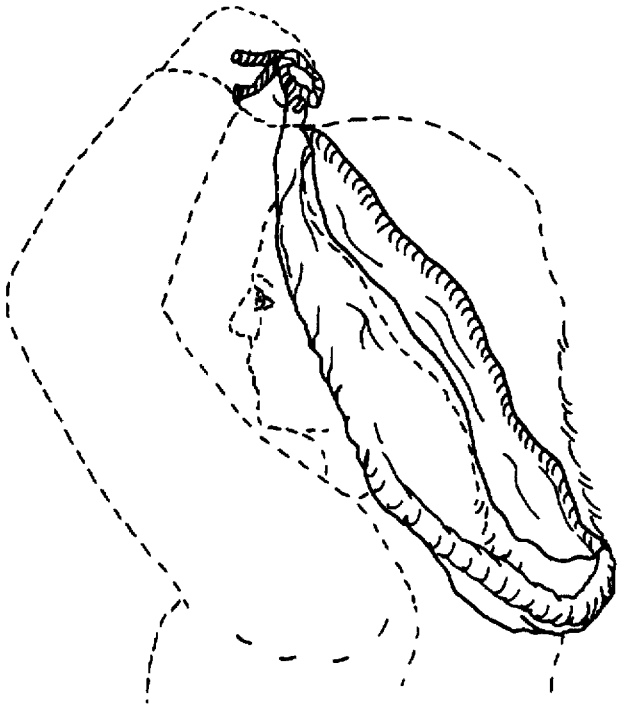
Figure 8:
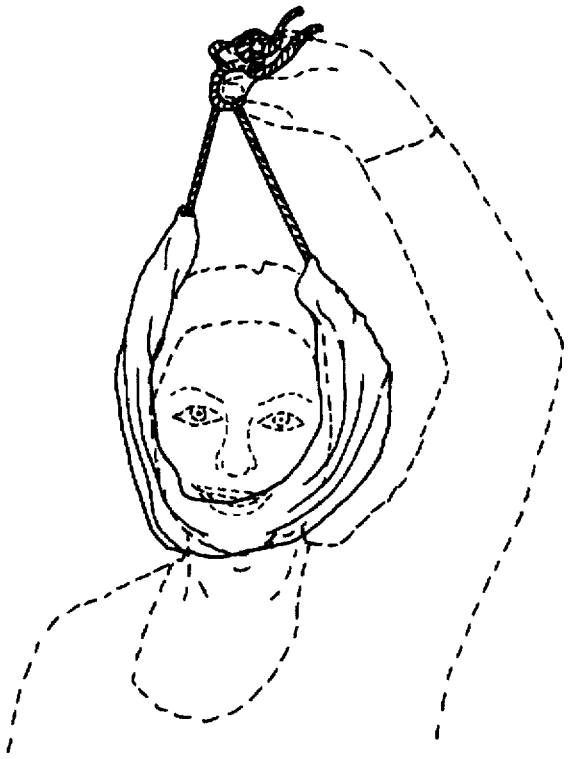
Figure 9:
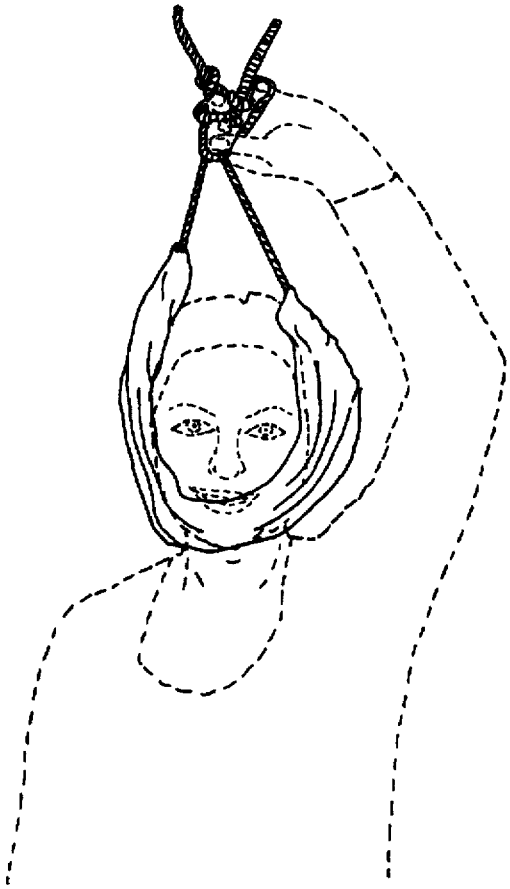
Figure 10:
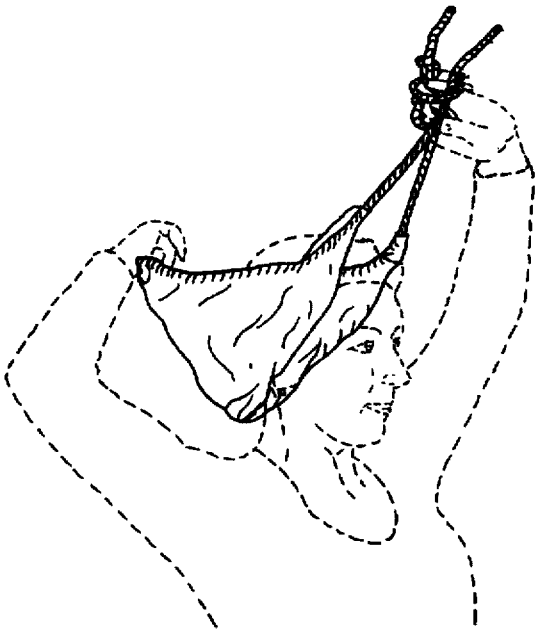
Figure 11:
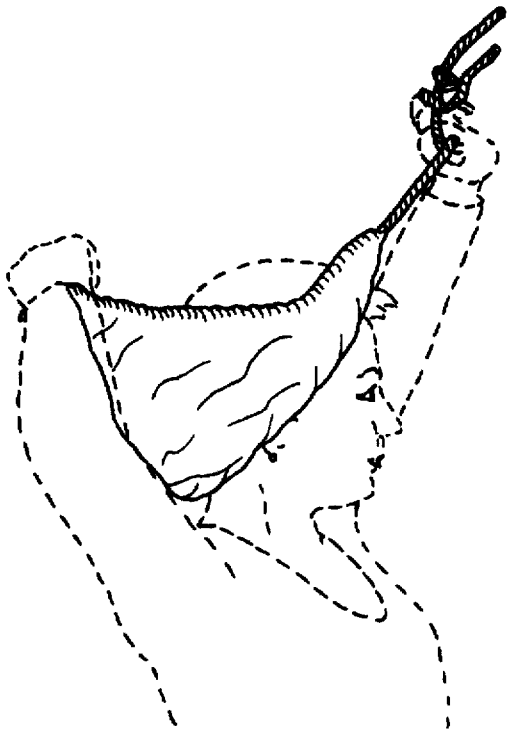
Figure 12:
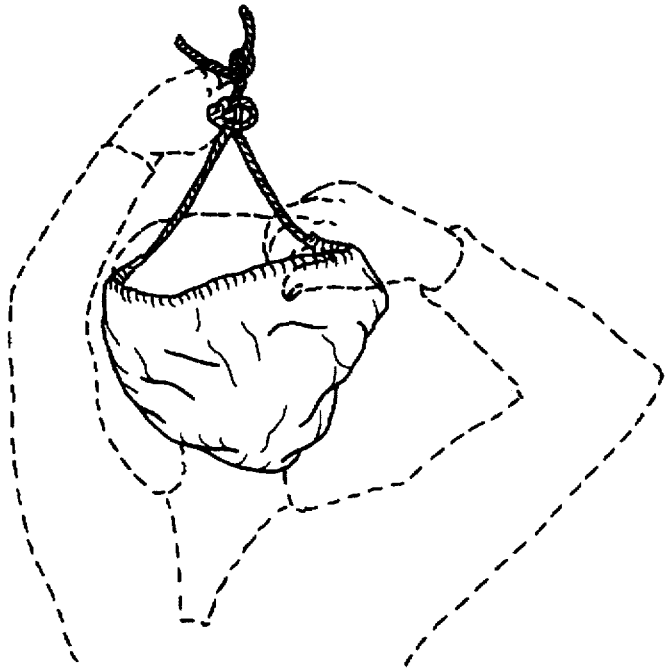
Figure 13:
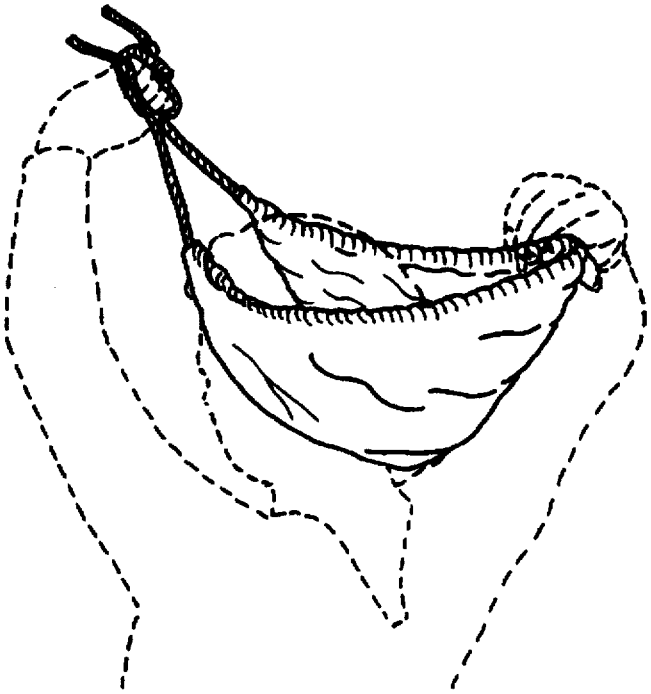
Figure 14:
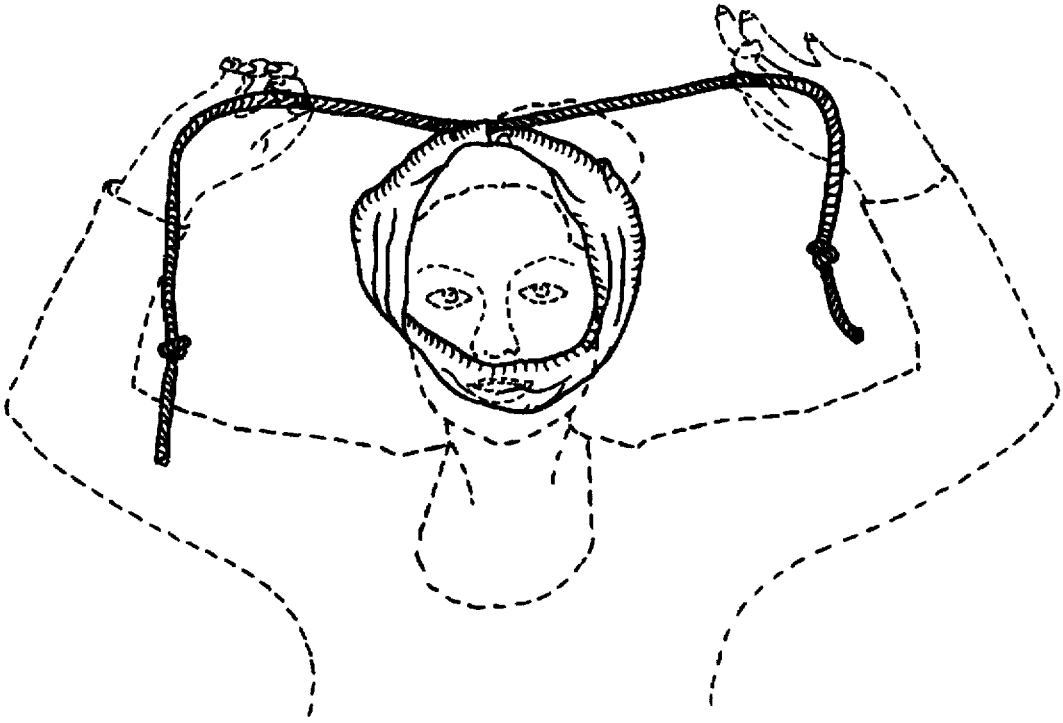
Figure 15:
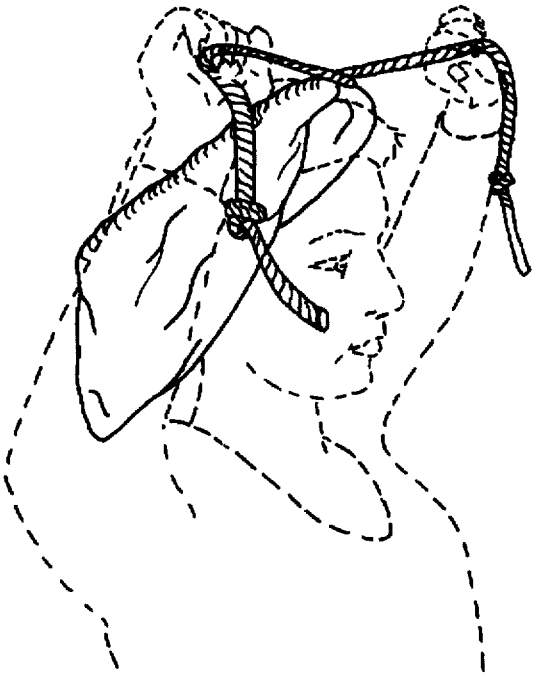
Figure 16:
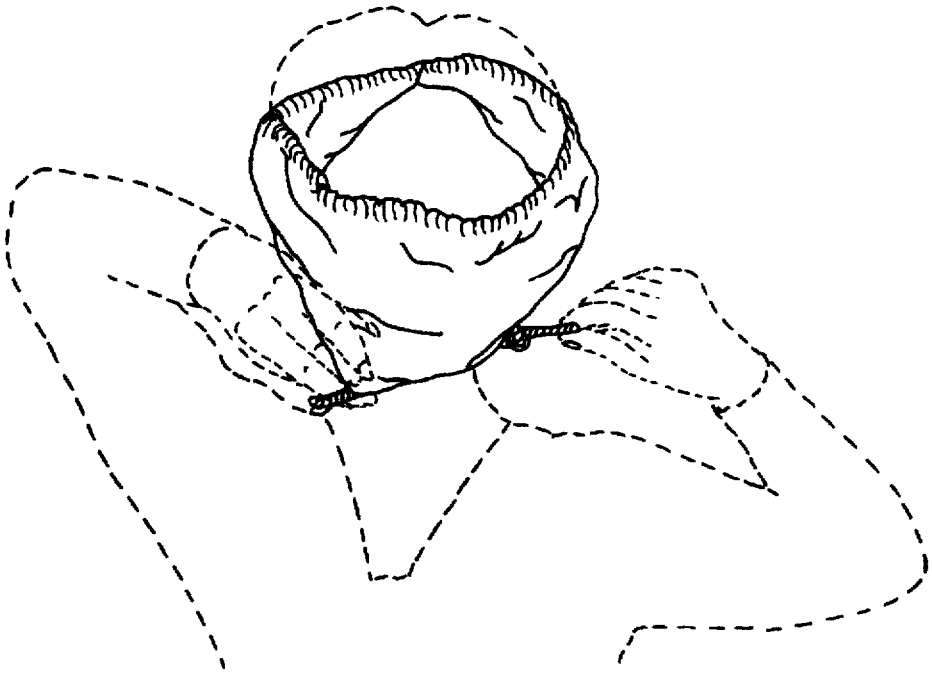
Figure 17:
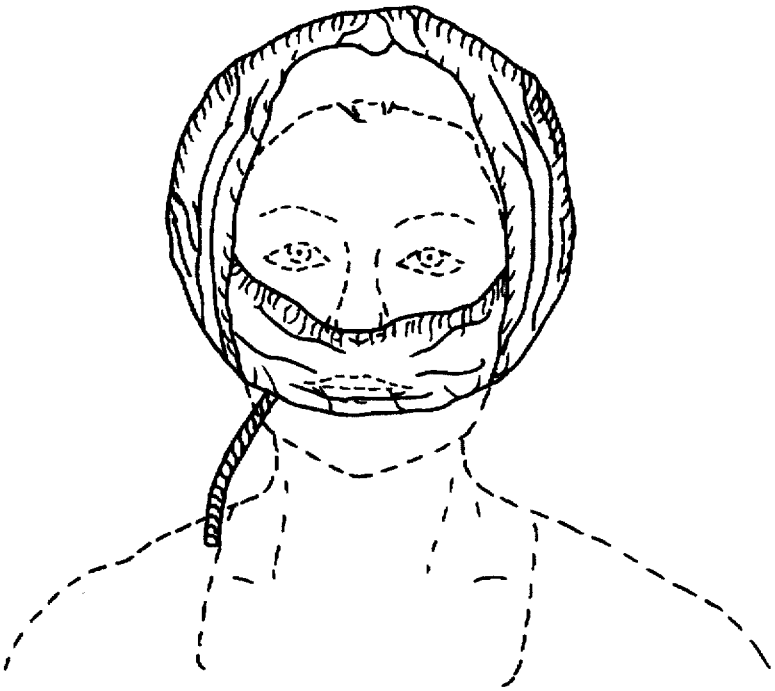

As seen in the drawings, a towel 20 of a suitable material such as a cotton terry cloth, is formed into a roughly semicircular shape 21 having an arcuate perimeter 22 and a straight portion 23. The perimeter 22 has a track 23 formed in the usual fashion by folding over an edge of the toweling and sewing a seam at 25. A drawstring 26 is threaded through the perimeter track 23 and extends at 27 and 28.

A suitable dimension might be for instance 24 inches with respect to the straight edged 23 and a 18 inch length from edge 23 to the outermost edge of the curve at 26.

Figure 18:
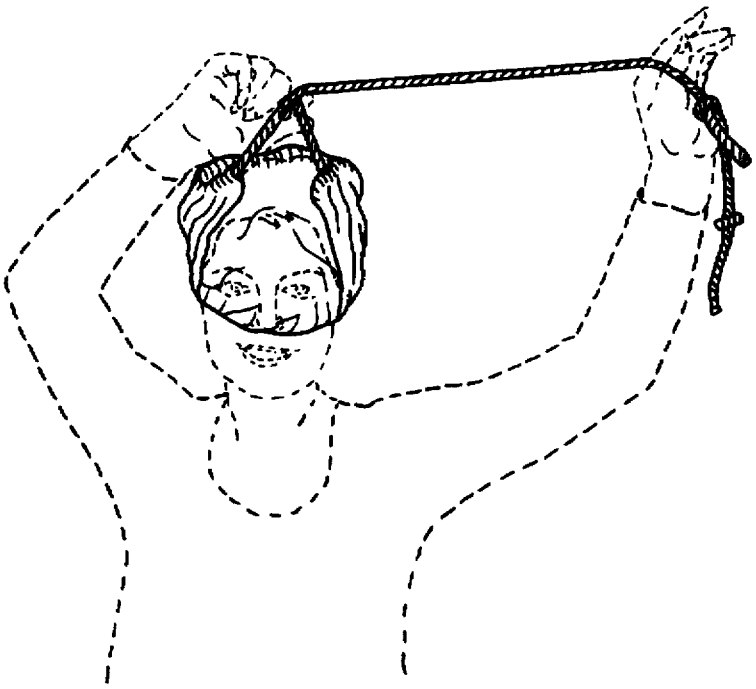
Figure 19:
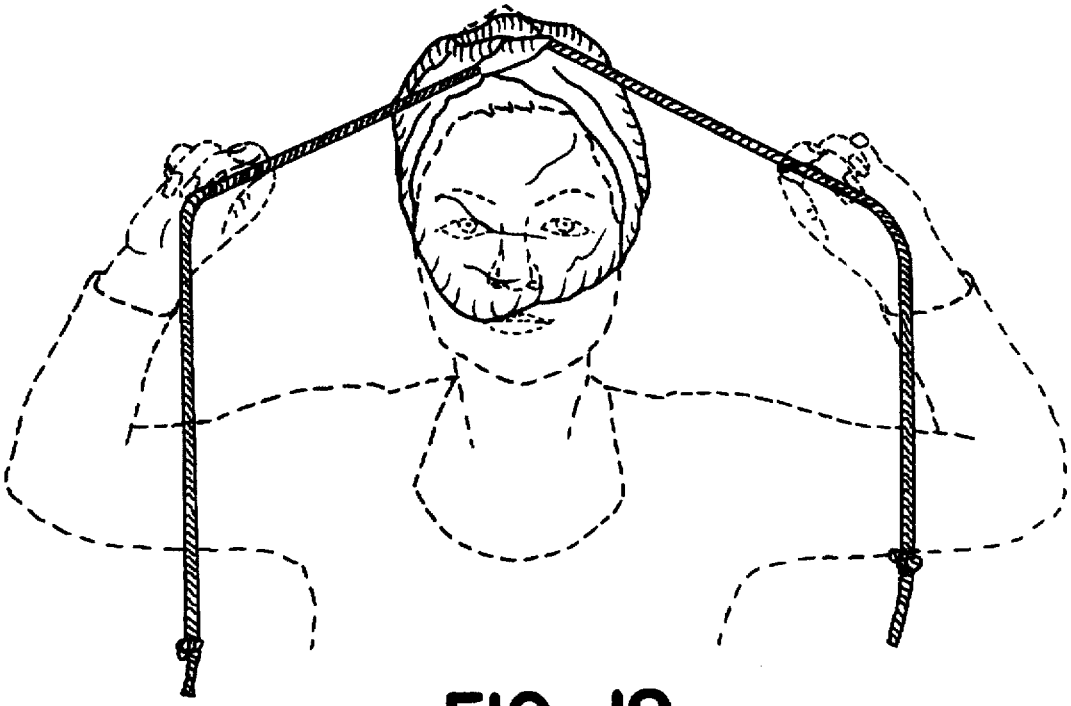
Figure 20:
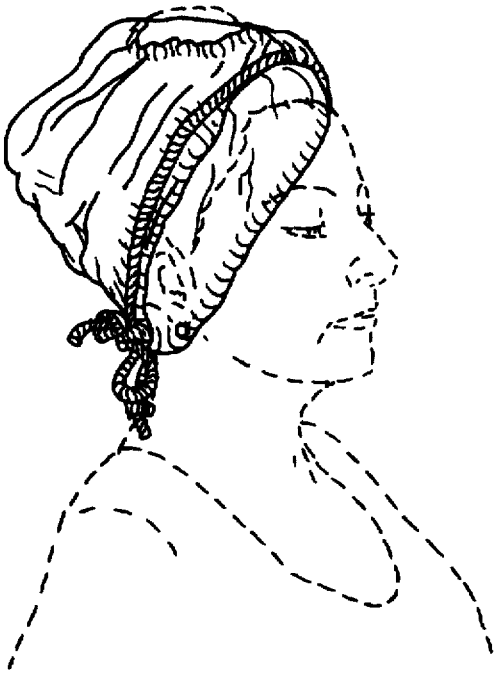
Figure 21:
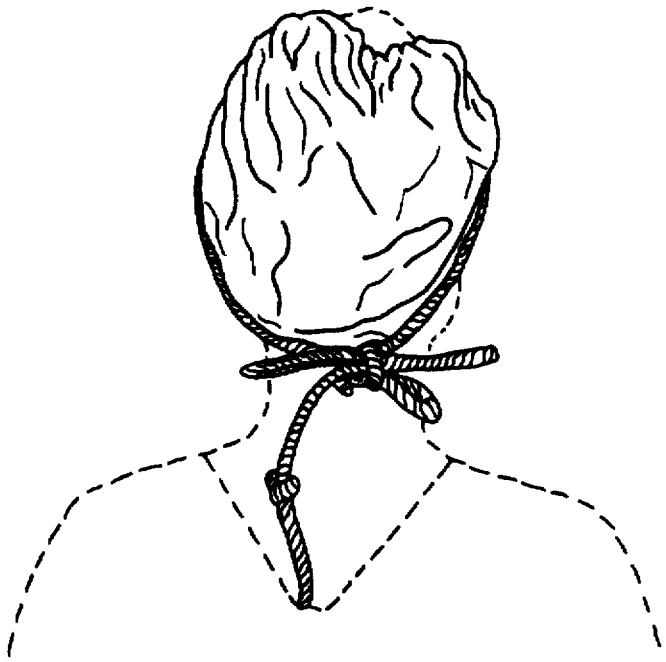
FIG. 21 is a back view showing the drawstring in place.
Figure 22:
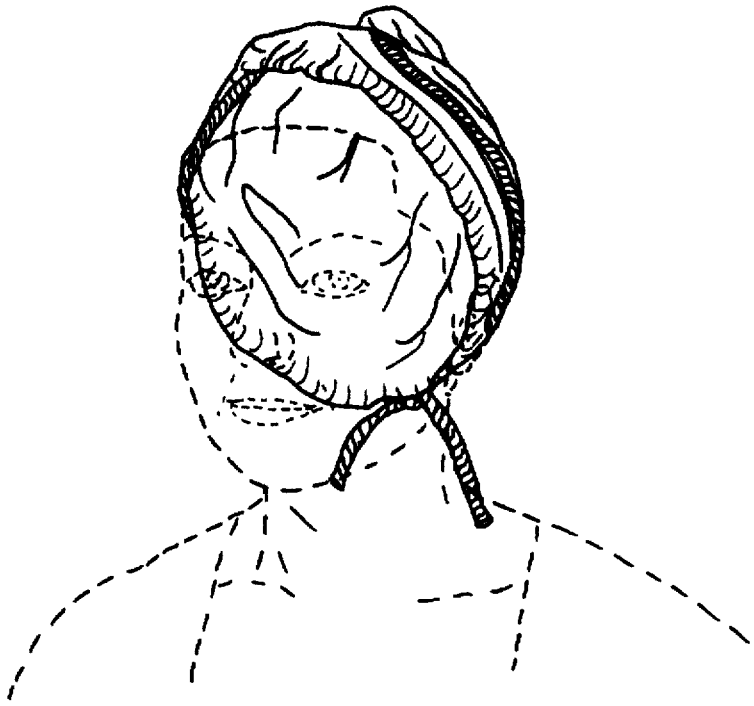
FIG. 22 shows the hair towel in place from a front somewhat oblique view.

In use the towel is folded from an initial position about the shoulders as seen in FIG. 1 to a wrapped position as seen in FIG. 22. The towel lies about the shoulders during the hair washing or treatment and absorbs liquids and protects the shoulders of the person whose hair is being done. The towel with the nap side desirably up acts as a cape. To wrap the hair towel of the invention around the hair the drawstring is pulled up as seen for instance in FIGS. 5 through 9. The lowest most portion of the towel is then raised as seen in FIGS. 10 through 13. This in effect forms a bag about the hair, with the bag open at the top. The drawstring is then pulled further closed as in FIGS. 14 through 18 to a position over the top of the hair. As seen in for instance FIGS. 18 and 19, the drawstring is tied and wound about the head downwardly and then suitably tied at the bottom as seen particularly in FIG. 21.

It will be seen that in the wrapped position as seen in FIGS. 21 and 22 with the hair towel in place, the drawstring acts as a securing device to both initially form in effect a bag about the hair, and then the drawstring acts as a securing device to secure the bag about the hair to the head.

As described above, the hair towel of the invention by virtue of the drawstring enables an arcuately shaped towel to first serve as a cape, and then to be fashioned into a bag about the hair, and then to permit the bag to be secured to the head of the person whose hair is being done.

After a suitable period of time the steps described above are reversed with the drawstring being untied and the towel removed.

I claim:

1. A towel for use in the washing and treatment of a user's hair consisting of a (1) generally semicircular shape with a straight edge and a curved edge, (2) track on the curved edge, (3) drawstring in the track; and (4) an absorbent toweling material, wherein said shape, track, and drawstring comprise means for (1) forming the towel from a cape into a bag, open at the top, that envelopes the user's hair; and (2) then securing the bag to the user's head.

* * * * *